US012370397B2

(12) United States Patent
Wang

(10) Patent No.: US 12,370,397 B2
(45) Date of Patent: Jul. 29, 2025

(54) WEIGHT BOX FOR FITNESS EQUIPMENT

(71) Applicant: Shenzhen Shenlaiyibi Technology Co., Ltd., Guangdong (CN)

(72) Inventor: Longfei Wang, Guangdong (CN)

(73) Assignee: Shenzhen Shenlaiyibi Technology Co., Ltd., Guangdong (CN)

( * ) Notice: Subject to any disclaimer, the term of this patent is extended or adjusted under 35 U.S.C. 154(b) by 82 days.

(21) Appl. No.: 18/400,024

(22) Filed: Dec. 29, 2023

(65) Prior Publication Data

US 2024/0131383 A1 Apr. 25, 2024

(30) Foreign Application Priority Data

Nov. 17, 2023 (CN) ..... 202323124233.6

(51) Int. Cl.
*A63B 21/06* (2006.01)
*A63B 71/00* (2006.01)

(52) U.S. Cl.
CPC ..... *A63B 21/0605* (2013.01); *A63B 71/0036* (2013.01)

(58) Field of Classification Search
CPC ... A63B 21/06; A63B 21/0605; A63B 21/072; A63B 21/0722; A63B 21/0724; A63B 21/0726; A63B 21/4035; A63B 71/0036; A63B 2210/50
See application file for complete search history.

(56) References Cited

U.S. PATENT DOCUMENTS

| | | | | |
|---|---|---|---|---|
| 793,101 | A * | 6/1905 | Schmidt | A61H 7/007 482/108 |
| 7,381,157 | B2 * | 6/2008 | Blateri | A63B 21/075 482/106 |
| 9,149,680 | B2 * | 10/2015 | Thompson | A63B 21/072 |
| 9,327,159 | B1 * | 5/2016 | Medina | A63B 21/0726 |
| 9,694,236 | B2 * | 7/2017 | Rost | A63B 22/16 |
| 9,914,007 | B2 * | 3/2018 | Pawlas | A63B 21/072 |
| 10,933,272 | B2 * | 3/2021 | Polinsky | A63B 21/0626 |
| 11,491,361 | B2 * | 11/2022 | Flick | A63B 21/072 |
| 11,878,198 | B2 * | 1/2024 | Shao | A63B 21/0004 |
| 11,878,201 | B2 * | 1/2024 | Sisler | A63B 21/075 |
| 2012/0252641 | A1 * | 10/2012 | Odneal | A63B 21/072 482/108 |
| 2014/0135186 | A1 * | 5/2014 | Reynolds | A63B 21/072 482/108 |
| 2015/0105224 | A1 * | 4/2015 | Odneal | B22D 17/00 164/47 |

(Continued)

*Primary Examiner* — Joshua Lee
(74) *Attorney, Agent, or Firm* — ScienBiziP, P.C.

(57) ABSTRACT

The present disclosure provides a weight box for fitness equipment, including a base, at least one weight plate, and a box body detachably connected to the base, wherein a cavity is formed between the box body and the base and configured for receiving the at least one weight plate. A first connection portion is arranged on the base of the weight box and configured to connect with a holding rod, so as to assemble the fitness equipment into a dumbbell or barbell. A second connection portion is provided on two opposite sides of the weight box and configured to connect with a lifter, so as to assemble the fitness equipment into a kettlebell or a spring exerciser. The weight box provided by the present disclosure can not only be used for various fitness equipment, but also be quickly assembled.

11 Claims, 14 Drawing Sheets

(56) References Cited

U.S. PATENT DOCUMENTS

| | | | | |
|---|---|---|---|---|
| 2015/0196792 | A1* | 7/2015 | Towley | A63B 21/075 482/93 |
| 2015/0343257 | A1* | 12/2015 | Cooper | A63B 21/0609 482/93 |
| 2018/0169460 | A1* | 6/2018 | Chen | A63B 21/075 |
| 2022/0040520 | A1* | 2/2022 | Tran | A63B 21/0726 |

* cited by examiner

WEIGHT BOX FOR FITNESS EQUIPMENT

CROSS-REFERENCES TO RELATED APPLICATIONS

This application claims the benefit of priority to Chinese Patent Application Number 202323124233.6, filed on Nov. 17, 2023, in the China National Intellectual Property Administration. The entire contents of the above-identified application are hereby incorporated by reference.

FIELD OF THE INVENTION

The present disclosure relates to the field of fitness equipment, particularly relates to a weight box for fitness equipment.

BACKGROUND

With the improvement of life standards, people have higher expectations for their health by improving physical fitness through various fitness activities, such as using dumbbells, kettlebells, barbells, etc. Even though the appearances and fitness characteristics of each equipment are different among the above-mentioned fitness equipment, weight plates are used to adjust the weight of the equipment.

The present weight plates may not be quickly assembled with fitness equipment to meet the fitness requirements. Moreover, because the weight plates may have a monotonous outlook and a single function, therefore, may not be shared between the fitness equipment. Such weight plates may also lack variability and aesthetics.

SUMMARY OF THE DISCLOSURE

The present disclosure proposes a weight box for fitness equipment to solve the problems in the above-mentioned background art that the weight plates of existing fitness equipment cannot be shared, is complicated to assemble, is inconvenient to adjust the weight, and has single function.

The technical solutions of the present disclosure are implemented as below:

A weight box for fitness equipment, wherein includes a base, at least one weight plate, and a box body detachably connected to the base, wherein a cavity is formed between the box body and the base and configured for receiving the at least one weight plate. A fixing device is connected to the at least one weight plate, wherein the at least one weight plate is arranged on the base by the fixing device. A first connection portion is arranged on the base of the weight box and configured to connect with a holding rod, so as to assemble the fitness equipment into a dumbbell or barbell. A second connection portion is provided on two opposite sides of the weight box and configured to connect with a lifter, so as to assemble the fitness equipment into a kettlebell or a spring exerciser.

As a further optimization, the fixing device includes a threaded rod installed on a center of the weight box, and the weight plate is sleeved on the threaded rod and locked by a first screw nut.

As a further optimization, the threaded rod is fixed on the base.

As a further optimization, the base includes a top cover and a bottom cover detachably connected with the top cover, and a positioning plate provided between the top cover and the bottom cover and being integrally connected with a lower end of the threaded rod. The positioning plate and the threaded rod can be fixed after the top cover and a bottom cover being assembled.

As a further optimization, a convex block is arranged on a lower surface of the weight plate and is outwardly protruding; a recessed slot is arranged on upper surface of the weight plate and is inwardly recessed to match the convex block; and the convex block can be inserted into the recessed slot to prevent relative rotation of two adjacent weight plates.

As a further optimization, the upper end of the threaded rod extends to an outer position of the box body, and a rotary knob is provided above the box body, and the box body can be connected to the base by tightening the rotary knob.

As a further optimization, the first connection portion is a threaded connection hole defined on a center of the base, and the holding rod is connected to the base through threaded connection.

As a further optimization, the holding rod includes an inner sleeve, two convex rings being respectively provided on the two ends of the inner sleeve and each of the two convex rings protruding outwardly; a groove formed between the two convex rings; a third screw nut, one end part of the third screw nut is provided with external threads connected to the threaded connection hole of the base; and a threaded hole radially positioned on the third screw nut.

As a further optimization, the holding rod further includes a screw joint casing connected with the third screw nut in threads, and the screw joint casing is fixedly connected with an inner extension sleeve.

As a further optimization, the second connection portion are screw holes arranged on the inner opposite sides of the box body; two installation slots are respectively arranged at two opposite sides of the box body, so that the lifter can be put into the installation slots and installed on the screw holes in a way of screwing.

As a further optimization, the lifter can be a U-shaped handle.

As a further optimization, the lifter can be a pulling rope.

The present disclosure includes the following benefits when using the technical solutions above:

The present disclosure provides a weight box which can not only be used for various fitness equipment, but also be quickly assembled to various fitness equipment, solving the problem that the existing dumbbell plates is complicated to assemble. Moreover, the weight plates can be placed inside the weight box, by which different numbers of the weight plates can be used to change the whole weight of the weight box. The detachable and interchangeable box body can be made into a variety of shapes according to different user groups and scenarios to meet the needs of different users, which is versatile in multiple scenarios, has diverse shapes, and is easy to assemble.

DETAILED DESCRIPTION

Figure 1:
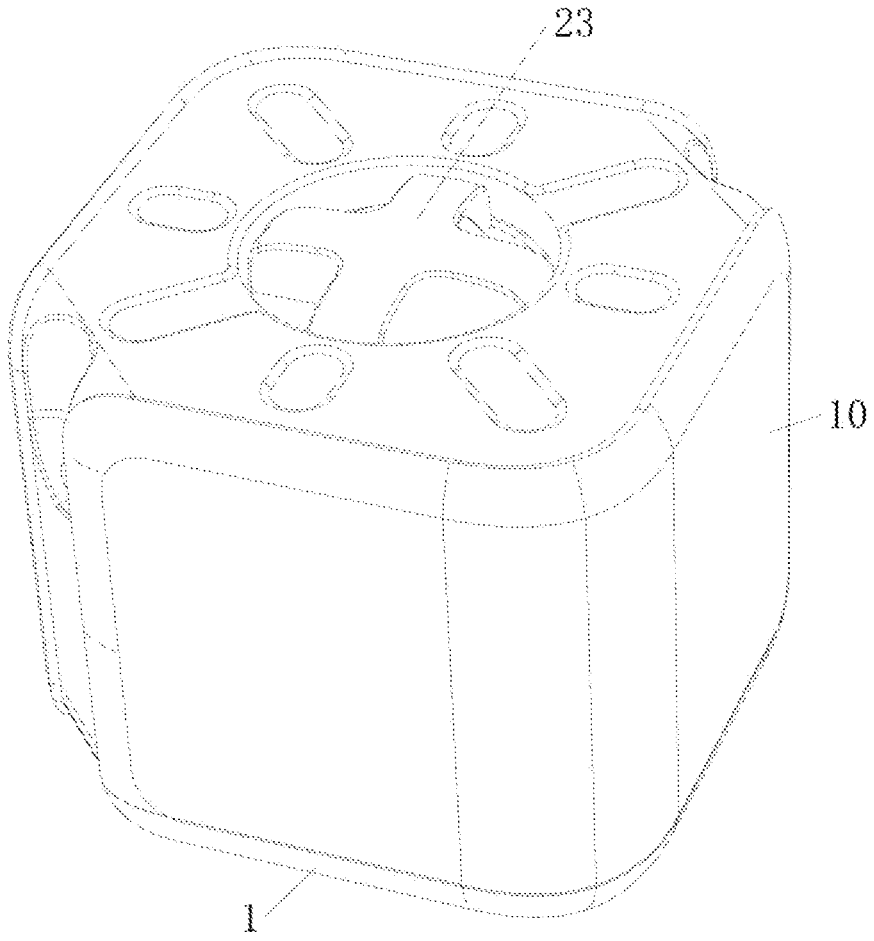
FIG. 1 is a three-dimensional structure diagram illustrating a weight box configured for fitness equipment according to the present disclosure.
Figure 2:
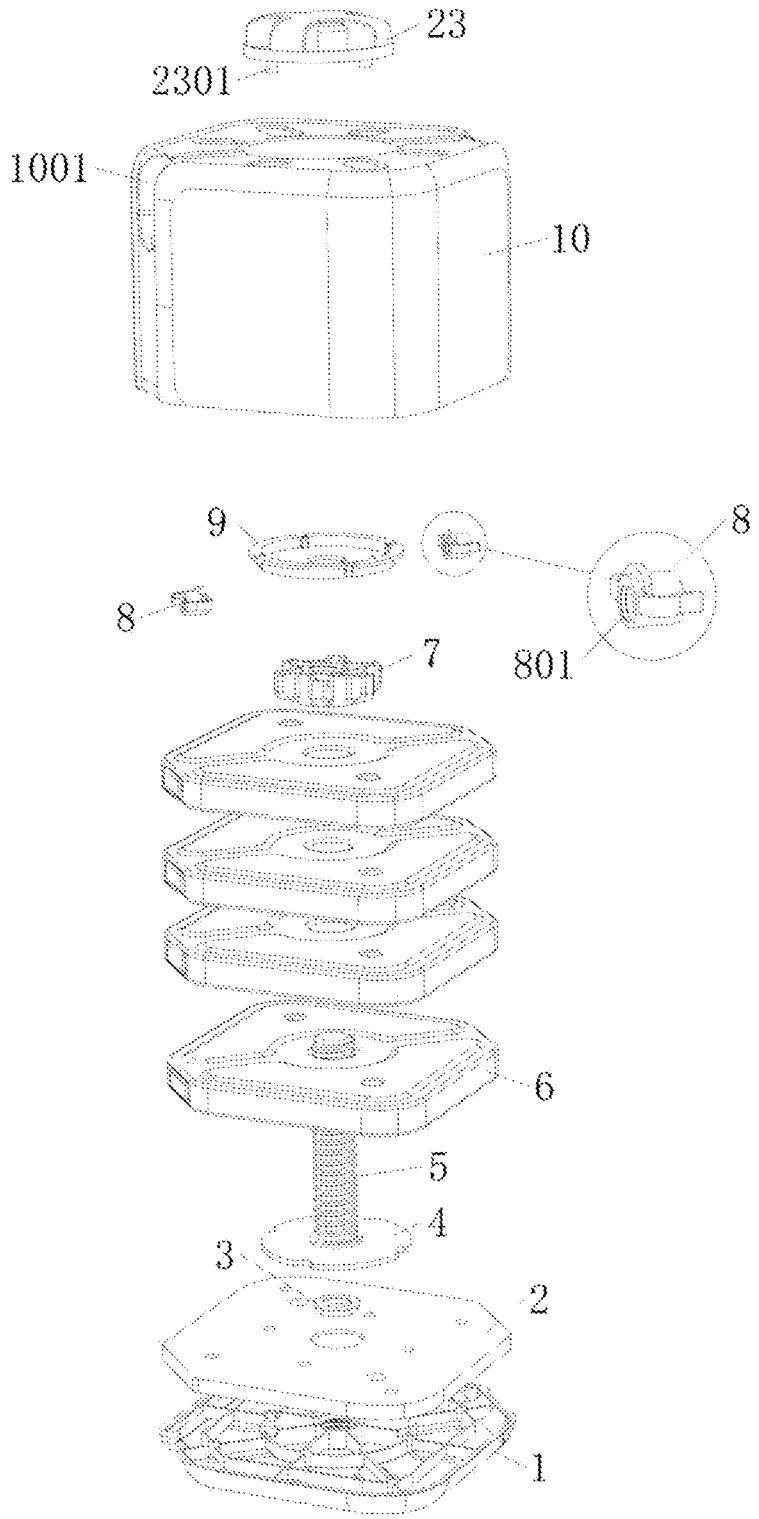
FIG. 2 is exploded schematic diagram illustrating the weight box for fitness equipment shown in FIG. 1.
Figure 3:
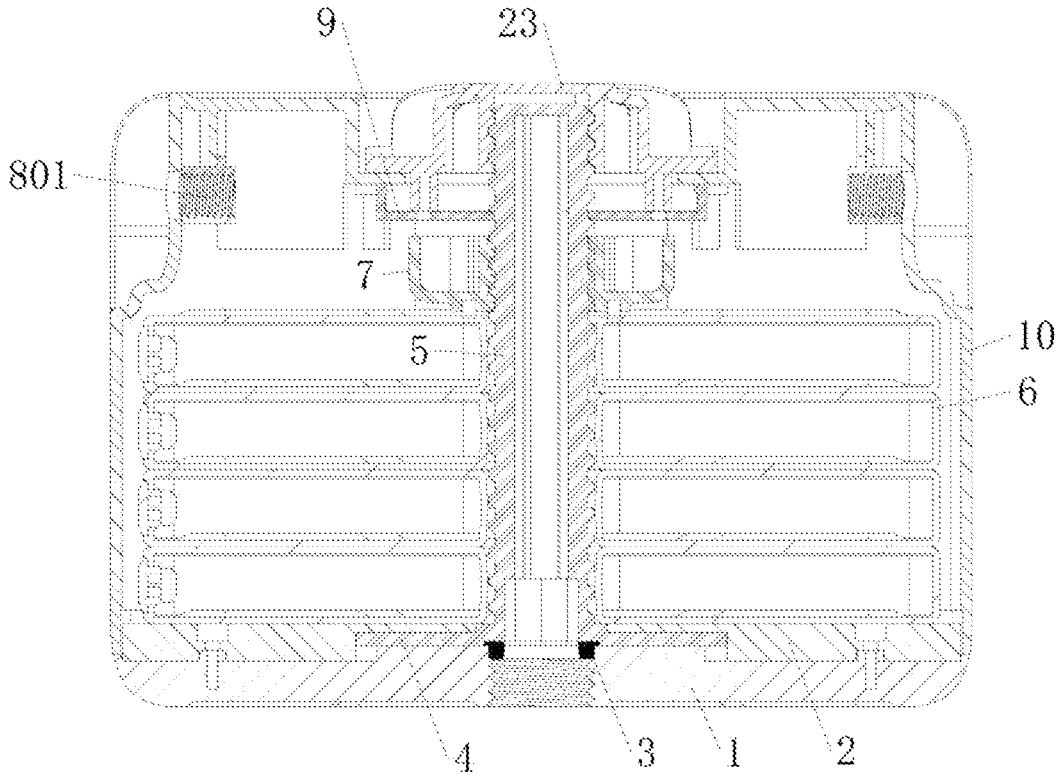
FIG. 3 is a sectional view diagram illustrating the weight box for fitness equipment shown in FIG. 1.
Figure 4:
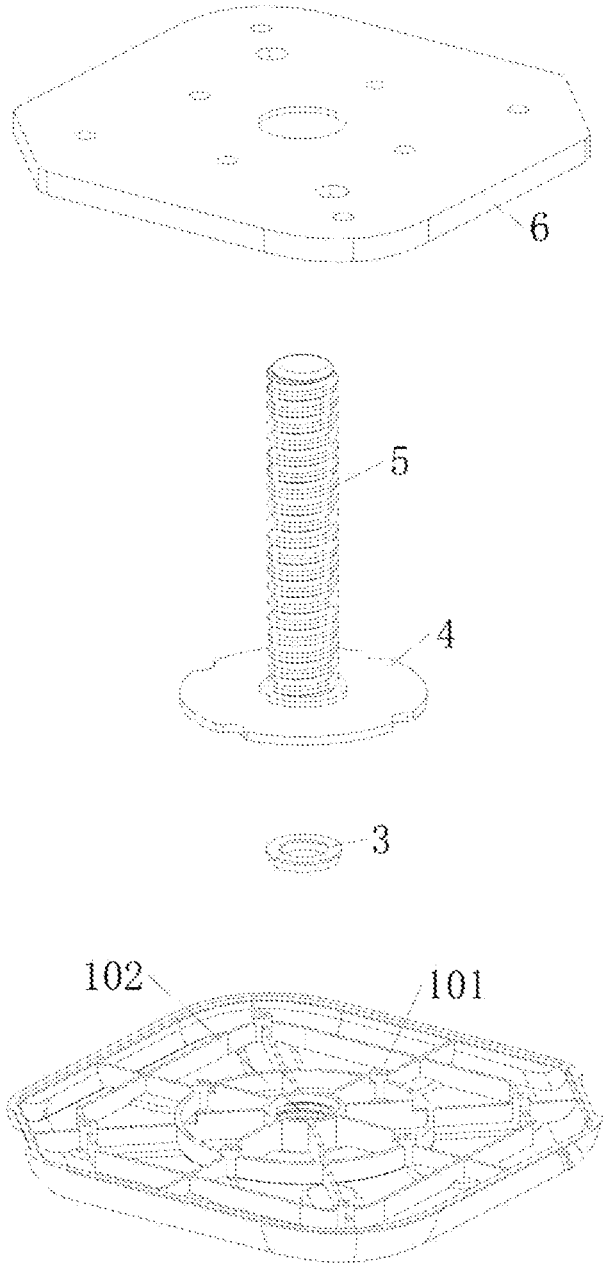
FIG. 4 is exploded schematic diagram illustrating a connection between a base and a threaded rod of the weight box shown in FIG. 1.
Figure 5:
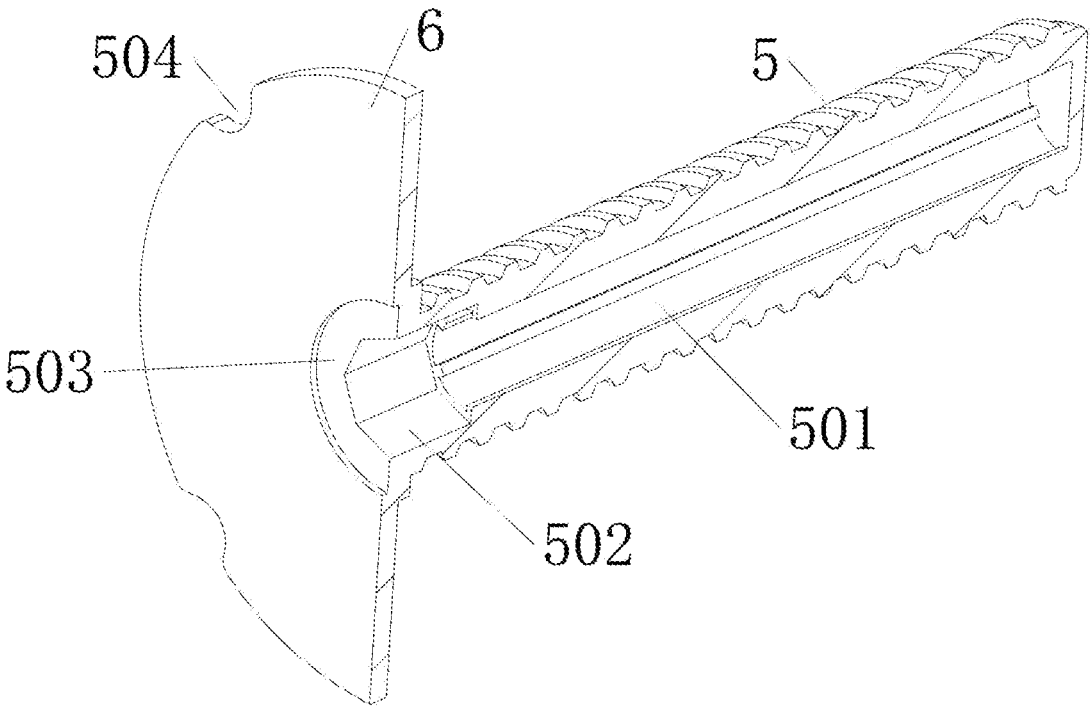
FIG. 5 is a sectional view diagram illustrating the threaded rod shown in FIG. 4.
Figure 6:
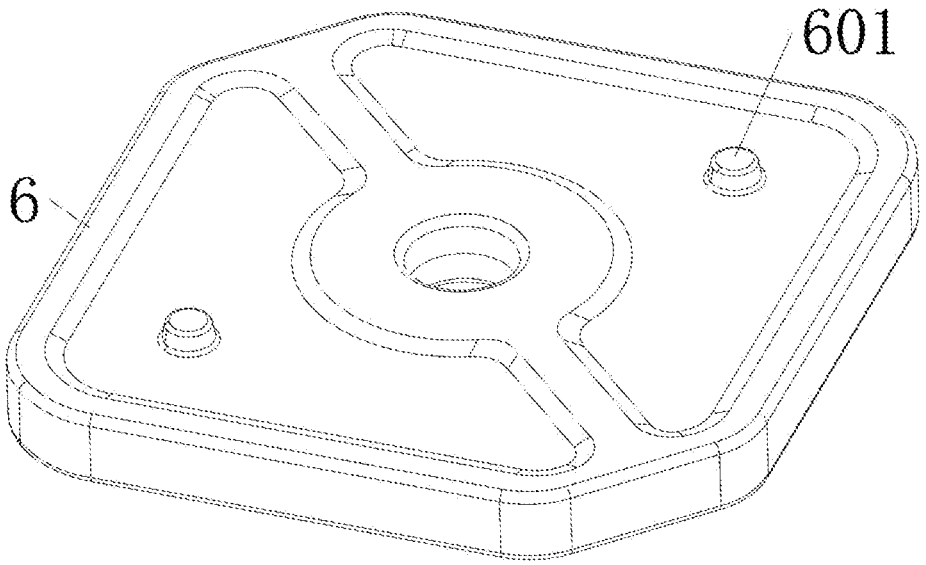
FIG. 6 is a three-dimensional structure diagram illustrating a weight plate of the weight box shown in FIG. 2
Figure 7:
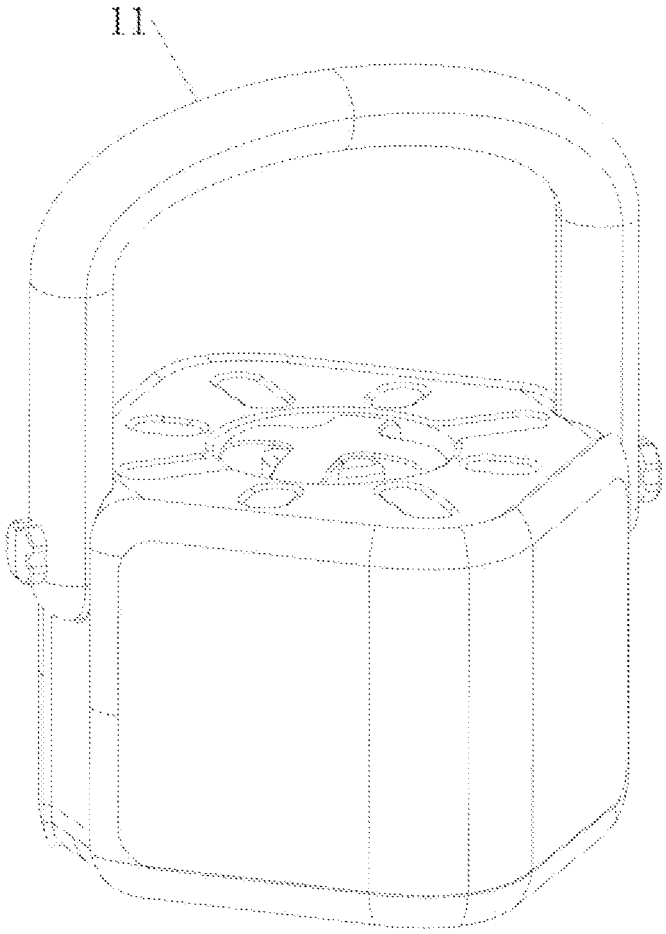
FIG. 7 is a three-dimensional structure diagram illustrating a kettlebell assembled by a handle and the weight box shown in FIG. 1.

In order to further describe the technical solutions of the present disclosure, specific embodiments of the present disclosure combined with the accompanying drawings are stand here. It should be understood that the detailed embodiments of the disclosure described here are used to explain the present disclosure only, instead of limiting the present disclosure.

Referring to FIGS. 1-14, the present disclosure provides a weight box for fitness equipment. The weight box for fitness equipment includes a base, at least one weight plate 6, and box body 10 detachably connected to the box body 10, wherein a cavity is formed between the box body 10 and the base and configured for receiving at least one weight plate 6. A fixing device is connected to the at least one weight plate, wherein the at least one weight plate is arranged on the base by the fixing device. The box body 10 further includes a first connection portion and a second connection portion. The first connection portion is arranged on the base of the weight box and configured to connect with a holding rod, so as to assemble the fitness equipment into a dumbbell or barbell. The second connection portion is arranged on two opposite sides of the weight box and configured to connect with a lifter, so as to assemble the fitness equipment into a kettlebell or a spring exerciser.

In this embodiment, the weight box for fitness equipment includes four weight plates 6, and in other embodiment, there is no limit to the number of the weight plate 6.

Wherein, a different number of the weight plates 6 can be put into the cavity formed between the box body 10 and the base according to users' needs, so as to change the whole weight of the weight box. The first connection portion and the second connection portion are arranged on the weight box, so as to quickly assemble the fitness equipment into a dumbbell, barbell, kettlebell, or spring exerciser, which avoid time wasting to assemble traditional dumbbell plates on corresponding fitness equipment. It can also make a single weight box being assembled as different fitness equipment only to match other parts of the fitness equipment (such as holding rod and lifter), which decrease investment cost. Moreover, the detachable and interchangeable box body can be designed into various shapes according to different scenarios and needs, such as upright shape for men, smooth shape for women, and cartoon shape for children, meeting the needs of different users. The detachable and interchangeable box body has advantages of being versatile in multiple scenarios, diverse in design, and easy to assemble.

Specifically, in this embodiment, a threaded rod 5 is arranged in the center of the weight box, and the four weight plates 6 are sleeved on the threaded rod 5 and locked by a first screw nut 7, the threaded rod 5 is fixed on the base. The base includes a bottom cover 1 and top cover 2 detachably connected to the bottom cover 1, and a positioning plate 4 arranged between the top cover 2 and the bottom cover 1, and the positioning plate 4 is integrally connected with a lower end of the threaded rod 5. After assembly, the top cover 2 and the bottom cover 1 can keep the positioning plate 4 and screw 5 fixed.

More specifically, in order to achieve a static state of the threaded rod 5 relative to the top cover 2 and the bottom cover 1, at least one limiting recess 504 is defined on side wall of the positioning plate 4, and at least one limiting pillar 101 is arranged on upper face of the bottom cover 1. When the top cover 2 is connected to the limiting pillar 101 through screws, the at least one limiting pillar 101 can be clipped into the at least one limiting recess 504, thereby preventing the positioning plate 4 and the threaded rod 5 from rotating relative to the base. Since the top cover 2 is connected to the bottom cover 1, the threaded rod 5 and the positioning plate 4 can be fixed when the positioning plate 4 is positioned between the top cover 2 and the bottom cover 1.

In this embodiment, the threaded rod 5 comprises four limiting recesses 504 spaced from each other, four limiting pillars 101 are arranged on the bottom cover 1, each of the four limiting pillars 101 is clipped into the corresponding limiting recess 504.

Specifically, in this embodiment, a convex block 601 is arranged on a lower surface of each of the four weight plates 6, and a recessed slot 602 is defined on an upper surface of each of the four the weight plates 6 corresponding to the convex block 601. When the four weight plates 6 are stacked, the convex block 601 of the upper weight plate 6 is inserted into the recessed slot 602 of the lower weight plate 6.

More specifically, the recessed slot 602 is defined on a surface of the top cover 2 contacted with the lowermost weight plate 6, and the recessed slot 602 matches the convex block 601, so that when the four weight plates 6 are sleeved on the threaded rod 5 and fixed by the first screw nut 7, and the convex block 601 is inserted into the recessed slot 602, the four weight plates 6 can be fixed. In order to improve the fixing effect, a rubber pad can be arranged between the first screw nut 7 and the uppermost weight plate 6 to prevent the four weight plates 6 form shaking during use.

Specifically, the upper end of the threaded rod 5 extends to an outer position of the box body 10, and a rotary knob 23 is provided above the box body 10, and the box body 10 can be connected to the base by tightening the rotary knob 23. As the rotary knob 23 is connected to the threaded rod 5 in threads and abuts the surface of the box body 10, it can prevent the threaded rod 5 from detaching downwardly. Further, a top wall of the box body 10 is provided with a limiting plate 9 through screw, and the limiting plate 9 is in contact with an extension pillar 2301 under the rotary knob 23. When the rotary knob 23 is in contact with the box body 10, the extension pillar 2301 contacts with the surface of the limiting plate 9 at the same time, which can avoid damage to the box body 10 when the rotary knob 23 is tightened.

Specifically, the first connection portion may be a threaded connection hole 102, and the threaded connection hole 102 is defined on a center of the base. A rubber ring 3 is arranged on a root of the threaded connection hole 102, and the holding rod is thready connected to the base through threaded connection.

More specifically, the threaded connection hole 102 is defined on the center of the bottom cover 1. The root of the threaded connection hole 102 is located at a contact position between the bottom cover 1 and the positioning plate 4, and the rubber ring 3 is arranged at the position. The upper surface of the rubber ring 3 abuts a stepped surface 503 of the positioning plate 4, so that the holding rod can be connected more tightly after being connected and to prevent the holding rod from shaking.

Figure 9:
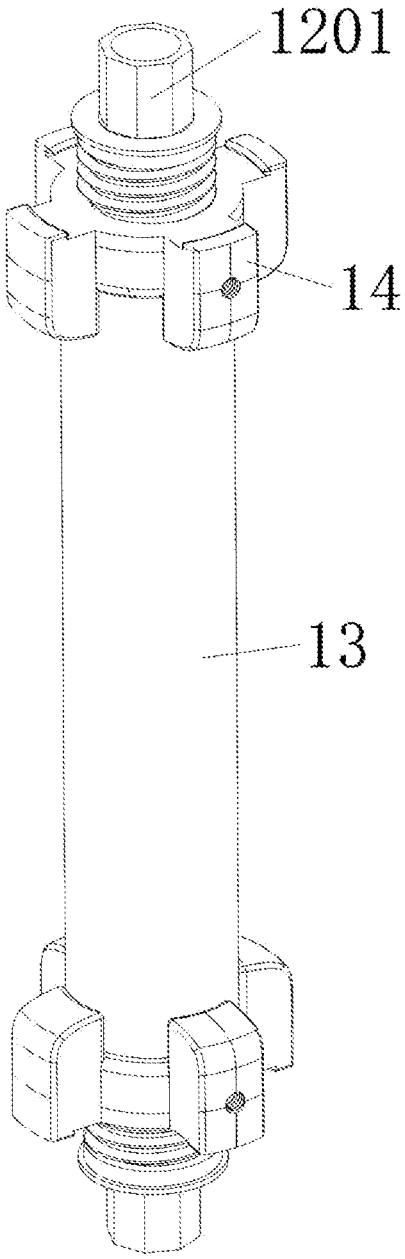
FIG. 9 is a three-dimensional structure diagram illustrating a holding rod of the dumbbell shown in FIG. 8.
Figure 10:
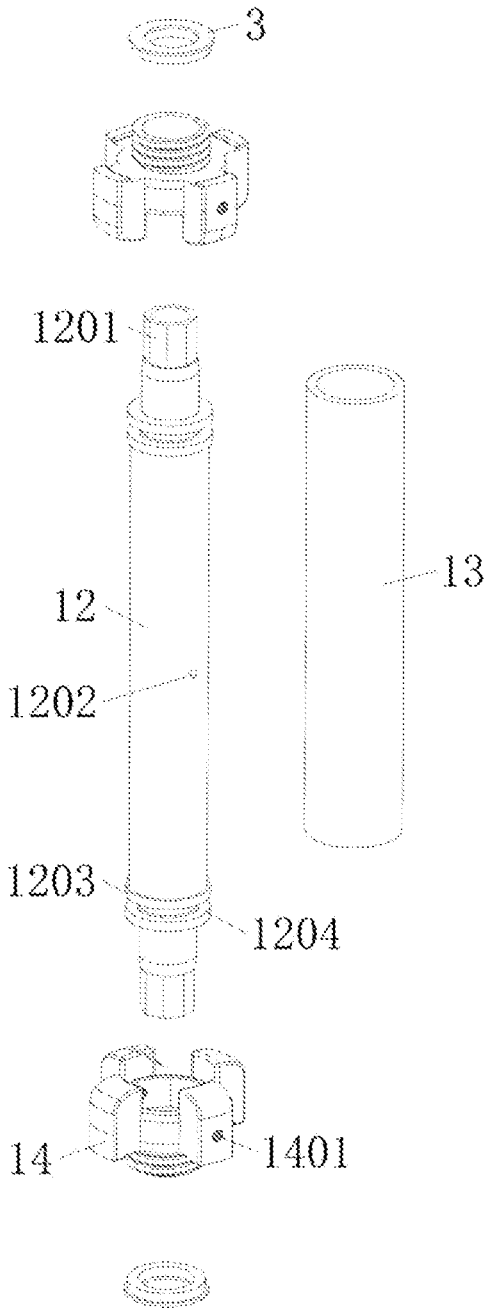
FIG. 10 is exploded schematic diagram illustrating the holding rod of the dumbbell shown in FIG. 8.

Specifically, referring to FIGS. 9-10, the holding rod includes an inner sleeve 12, two ends of the inner sleeve 12 are provided with two polygonal pillars 1201 respectively. Two convex rings 1203 are provided on the two ends of the inner sleeve 12, each of the two protruding rings 1203 protruding outwardly. A groove 1204 is defined between the two convex rings 1203. The holding rod further includes a third screw nut 14, one end of the third screw nut 14 is provided with external threads connected to the threaded connection hole 102 of the base, and a threaded hole 1401 radially positioned on the third screw nut 14.

Wherein, a polygonal hole 502 is defined on the bottom of the threaded rod 5, and the polygonal hole 502 is matched with the polygonal pillar 1201 provided on two ends of the inner sleeve 12. The polygonal pillar 1201 can be stuck into the polygonal hole 502, so as to prevent the inner sleeve 12 from rotating relative to the weight box. More specifically, in this embodiment, the cross-sectional shape of the polygonal pillar 1201 and the cross-sectional shape of the polygonal hole 502 are both regular octahedral shapes. In addition, other regular polyhedral structures can also be used.

After inserting the inner sleeve 12 into the threaded rod 5, rotate the third screw nut 14 installed at two ends of the inner sleeve 12, so that the third screw nut 14 is connected to the threaded connection hole 102. The threaded hole 1401 is radially positioned on the third screw nut 14 can be passed through by a screw or a bolt, and the ends of the screw or bolt are arranged inside the groove 1204, so that when the third screw nuts 14 rotate, it can drive the inner sleeve 12 to move axially, thereby gradually tightening the weight box. Moreover, an outer sleeve 13 is provided on the outside of the inner sleeve 12, which can prevent the inner sleeve 12 from wearing out after a long period of time.

Figure 8:
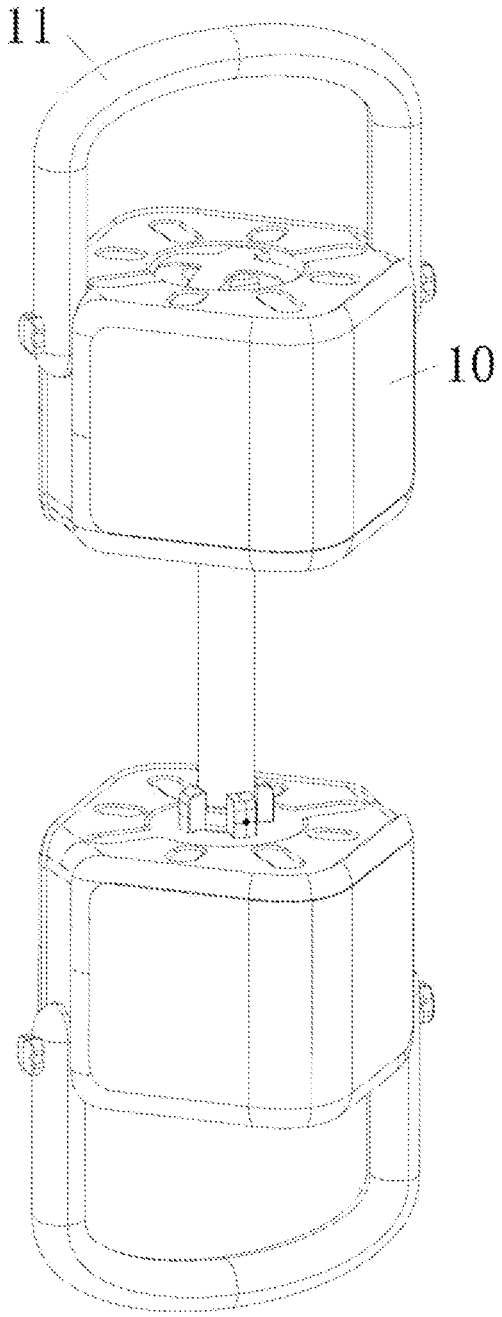
FIG. 8 is a three-dimensional structure diagram illustrating a dumbbell assembled by a holding rod and the weight box shown in FIG. 1.

After the above-mentioned holding rod and the four weight plates 6 are assembled, the dumbbell structure formed is as shown in FIG. 8 (the handle 11 can be disassembled).

Figure 12:
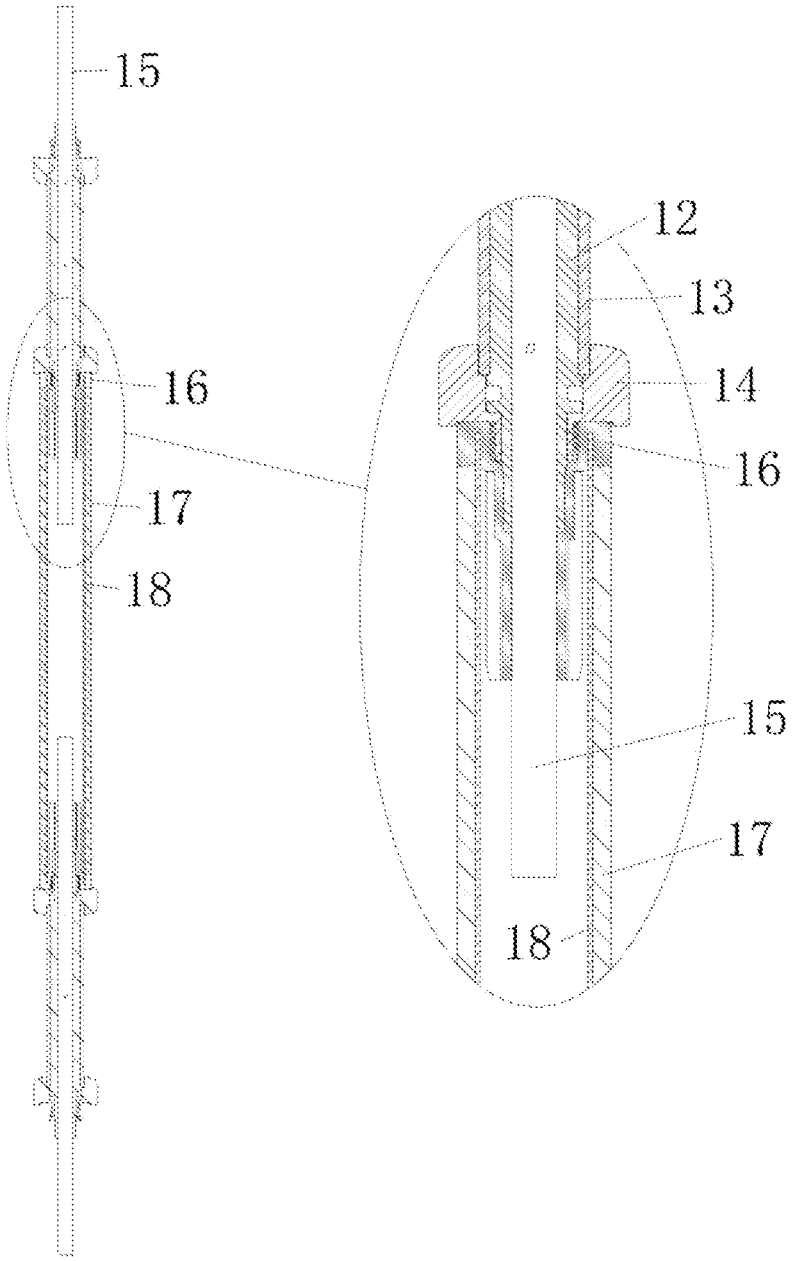
FIG. 12 is a sectional view diagram illustrating the holding rod of the barbell shown in FIG. 11.
Figure 13:
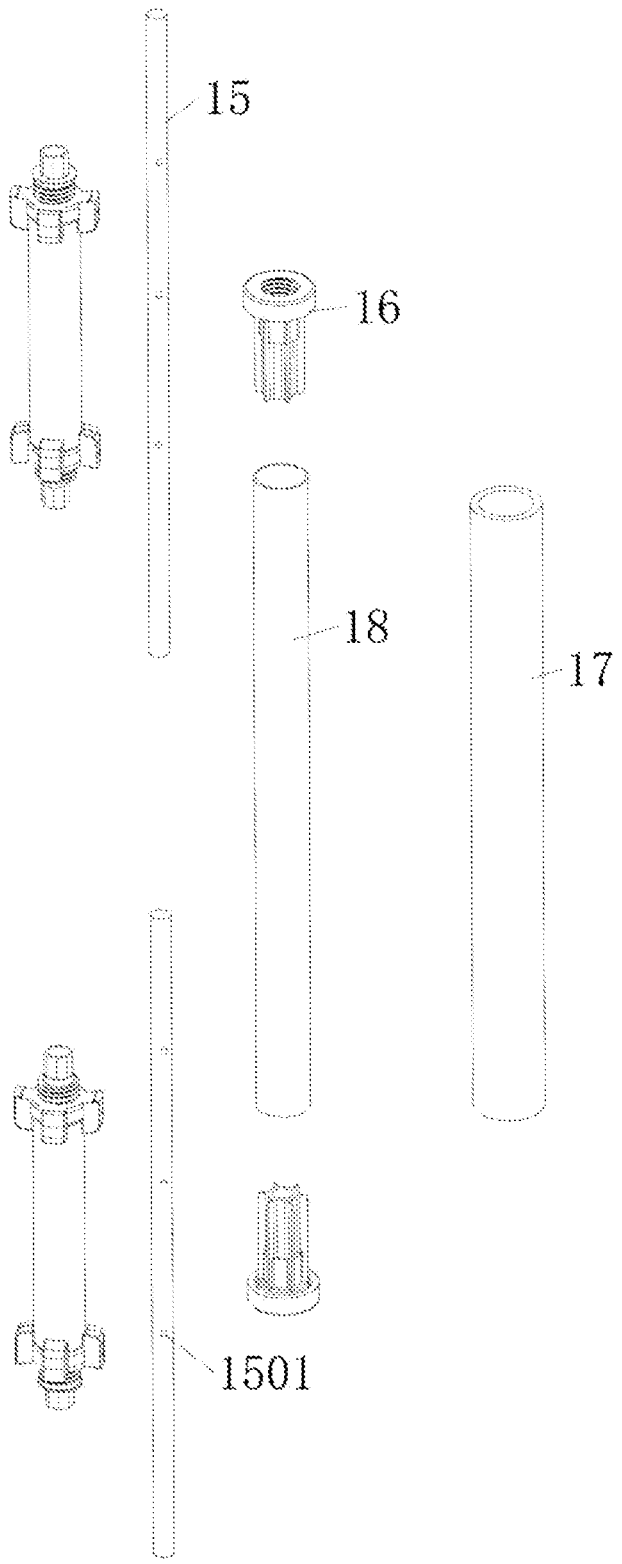
FIG. 13 is exploded schematic diagram illustrating the holding rod of the barbell shown in FIG. 11.

Specifically, referring to FIGS. 12-13, the holding rod further includes a screw joint casing 16 connected with the third screw nut 14 through threaded connection, and the screw joint casing 16 is fixedly connected with an inner extension sleeve 18. That is, the screw joint casing 16 can be connected with the third screw nut 14 of the dumbbell holding rod.

In this embodiment, the holding rod includes two screw joint casings 16, the inner extension sleeve 18 is fixedly arranged between the two screw joint casings 16, so that the overall length of the holding rod can be extended and used as a barbell holding rod. More specifically, in order to further improve the structure stability of the barbell holding rod, a strengthening rod 15 is provided in center of the inner sleeve 12. One end of the strengthening rod 15 is extended into a central hole 501 of the threaded rod 5, another end is extended to the inner extension sleeve 18. A radial screw hole 1202 is defined on radial position of the inner sleeve 12, and a radial hole 1501 is defined on radial position of the strengthening rod 15. A screw can be inserted into the radial screw hole 1202, and the end of the screw extends into the radial hole 1501, so that the strengthening rod 15 can be locked. An outer extension sleeve 17 is installed on the outside of the inner extension sleeve 18, so as to prevent the inner extension sleeve 18 from wearing.

Figure 11:
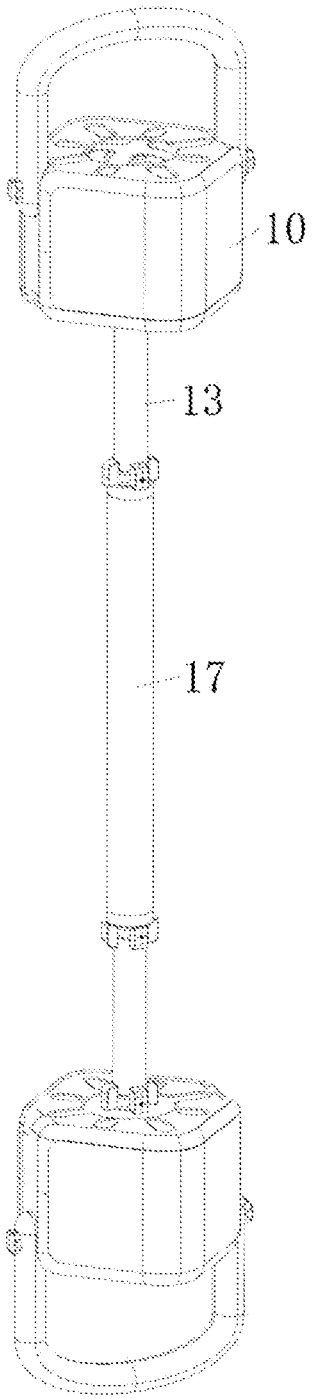
FIG. 11 is a three-dimensional structure diagram illustrating a barbell assembled by the holding rod and the weight box shown in FIG. 1.

After the above-mentioned holding rod and the four weight plates 6 are assembled, the barbell structure formed is as shown in FIG. 11 (the handle 11 can be disassembled).

Specifically, the second connection portion are screw holes 801 arranged on inner opposite sides of the box body 10. Two installation slots 1001 are respectively arranged at two opposite sides of the box body 10 to install a lifter, so that the lifter can be put into the installation slots 1001 and installed on the screw holes 801 in a way of screwing. In this embodiment, two second screw nuts 8 are provided at two sides of the interior of the box body 10. The screw holes 801 of the second screw nuts 8 are connected to the outside of the box 10. The lifter can be placed in the installation slots 1001 and connected to the second screw nuts 8 through bolts.

Figure 14:
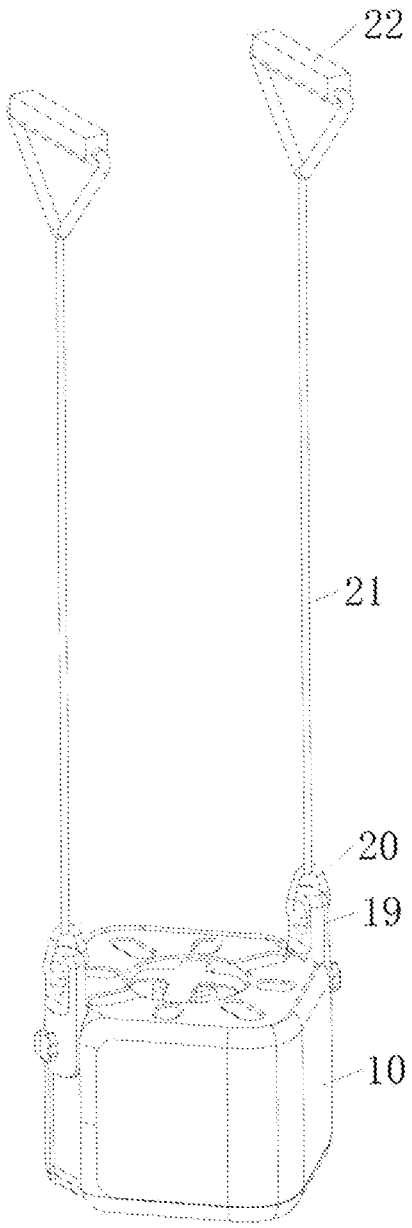
FIG. 14 is a three-dimensional structure diagram illustrating a spring exerciser assembled by a pulling rope and the weight box shown in FIG. 1.

Specifically, the lifter is a pulling rope 21. More specifically, the lifter includes a connection rack 19. A connection ring 20 is provided at upper end of the connection rack 19. The pulling rope 21 is installed on the connection ring 20, and a pulling ring 22 is connected to the upper end of the pulling rope 21. As shown in FIG. 14, the weight box can be used as a counterweight of a spring exerciser, wherein the pulling rope 21 can be steel rope.

The specific embodiments described herein are preferable examples to illustrate the spirit of the present disclosure only and not limiting the scope of this disclosure. Those skilled in the art to which the present disclosure belongs can make various modifications or additions to the specific embodiments described or use similar alternatives, but they will not deviate from the spirit or exceed the scope of the present disclosure.

REFERENCE SIGNS LIST

1: bottom cover
101: limiting pillar
102: threaded connection hole
2: top cover
3: rubber ring
4: positioning plate
5: threaded rod
501: central hole
502: polygonal hole
503: stepped surface
504: limiting recess
6: weight plate
601: convex block
602: recessed slot
7: first screw nut
8: second screw nut
801: screw hole
9: limiting plate
10: box body
1001: installation slot
11: handle
12: inner sleeve

1201: polygonal pillar
1202: radial screw hole
1203: convex ring
1204: groove
13: outer sleeve
14: third screw nut
1401: threaded hole
15: strengthening rod
1501: radial hole
16: screw joint casing
17: outer extension sleeve
18: inner extension sleeve
19: connection rack
20: connection ring
21: pulling rope
22: pulling ring
23: rotary knob
2301: extension pillar

What is claimed is:

1. A weight box for fitness equipment, comprising:
a base,
at least one weight plate,
a box body detachably connected to the base, wherein a cavity is formed between the box body and the base and configured for receiving the at least one weight plate,
a fixing device connected to the at least one weight plate, wherein the at least one weight plate is arranged on the base by the fixing device,
a first connection portion arranged on the base of the at least one weight box and configured for assembling the fitness equipment into a dumbbell or barbell,
a holding rod connected with the first connection portion,
a second connection portion arranged on two opposite sides of the box body and configured for assembling the fitness equipment into a kettlebell or a spring exerciser, and
a lifter connected with the second connection portion.

2. The weight box for fitness equipment according to claim 1, wherein the fixing device comprises a threaded rod installed on a center of the base, and the weight plate is sleeved on the threaded rod and locked by a first screw nut.

3. The weight box for fitness equipment according to claim 2, wherein the base comprises:
a bottom cover and a top cover detachably connected to the bottom cover, and
a positioning plate arranged between the top cover and the bottom cover, the positioning plate being integrally connected with a lower end of the threaded rod, and the positioning plate and the threaded rod being fixed after the top cover and a bottom cover being assembled.

4. The weight box for fitness equipment according to claim 2, wherein an upper end of the threaded rod extends to an outer position of the box body, and a rotary knob is provided above the box body, the box body is connected to the base by tightening the rotary knob.

5. The weight box for fitness equipment according to claim 1, further comprising:
a convex block configured to be arranged on a lower surface of the weight plate, the convex block projecting towards the base, and
a recessed slot configured to be arranged on an upper surface of the weight plate, the recess slot recessing towards the base to match the convex block, wherein
the convex block is inserted into the recessed slot to prevent relative rotations of two adjacent weight plates.

6. The weight box for fitness equipment according to claim 1, wherein the first connection portion is a threaded connection hole defined on a center of the base, and the holding rod is connected to the base through threaded connection.

7. The weight box for fitness equipment according to claim 6, wherein the holding rod comprises:
an inner sleeve, two ends of the inner sleeve being provided with two polygonal pillars respectively, two convex rings being respectively provided on the two ends of the inner sleeve, and each of the two convex rings protruding outwardly,
a groove defined between the two convex rings,
a third screw nut, one end part of the third screw nut being provided with external threads connected to the threaded connection hole of the base, and
a threaded hole radially positioned on the third screw nut.

8. The weight box for fitness equipment according to claim 7, wherein the holding rod comprises a screw joint casing connected with the third screw nut through threaded connection, and the screw joint casing is fixedly connected with an inner extension sleeve.

9. The weight box for fitness equipment according to claim 1, wherein the second connection portion are screw holes arranged on inner opposite sides of the box body, the lifter is installed in the screw hole by screwing.

10. The weight box for fitness equipment according to claim 1, wherein two installation slots are respectively arranged at two opposite sides of the box body, and the lifter is arranged in the installation slots.

11. The weight box for fitness equipment according to claim 1, wherein the lifter is a U-shaped handle or a pulling rope.

* * * * *